United States Patent [19]

Koch et al.

[11] Patent Number: 4,772,426

[45] Date of Patent: Sep. 20, 1988

[54] SURFACTANTS CONCENTRATES CONTAINING ESTER SULFONATES AND THEIR USE

[75] Inventors: Karlheinz Koch, Haan; Ingo Wegener; Brigitte Glesen, both of Duesseldorf, all of Fed. Rep. of Germany

[73] Assignee: Henkel Kommanditgesellschaft auf Aktien, Duesseldorf, Fed. Rep. of Germany

[21] Appl. No.: 11,649

[22] Filed: Feb. 6, 1987

[30] Foreign Application Priority Data

Feb. 6, 1986 [DE] Fed. Rep. of Germany ..... 3603580

[51] Int. Cl.[4] ..... C11D 1/12

[52] U.S. Cl. ..... 252/549; 252/89.1; 252/174.18; 252/174.21; 252/557

[58] Field of Search ..... 252/549, 174.18, 559, 252/174.21, 538, 540, 557, DIG. 1, DIG. 14, 108, 109, 121, ; 260/400

[56] References Cited

U.S. PATENT DOCUMENTS

| | | | |
|---|---|---|---|
| 3,274,117 | 9/1966 | Stein et al. | 252/109 |
| 3,632,517 | 1/1972 | Stirton et al. | 252/121 |
| 4,049,586 | 9/1977 | Collier | 252/135 |
| 4,404,143 | 9/1983 | Sekiguchi et al. | 260/400 |
| 4,416,809 | 11/1983 | Magari et al. | 252/174.18 |
| 4,495,092 | 1/1985 | Schmid et al. | 252/559 |

FOREIGN PATENT DOCUMENTS

| | | |
|---|---|---|
| 3333517 | 4/1984 | Fed. Rep. of Germany . |
| 3439520 | 4/1986 | Fed. Rep. of Germany . |

*Primary Examiner*—A. Lionel Clingman
*Assistant Examiner*—Hoa Van Le
*Attorney, Agent, or Firm*—Ernest G. Szoke; Henry E. Millson, Jr.; Real J. Grandmaison

[57] ABSTRACT

Ester-sulfonate-containing liquid surfactant concentrates containing one or more surfactants in a quantity of 50 to 70% by weight, based on the total weight of the concentrates, selected from the group consisting of alkali metal of α-sulfonated fatty acid alkyl esters such as anionic surfactants and linear aliphatic fatty alcohol polyglycol ethers as nonionic surfactants in a ratio of anionic surfactant to nonionic surfactant of from 1:0.3 to 1:3, one or more saturated and/or unsaturated linear aliphatic carboxylic acids in a quantity of from 10 to 30% by weight, based on the total weight of the concentrates, and water in a quantity of from 0 to 10% by weight, based on the total weight of the concentrates. The invention also relates to the use of these concentrates in fabric detergents, dishwashing detergents and cleaning preparations for domestic and industrial purposes.

11 Claims, 11 Drawing Sheets

Viscosity in dependence upon temperature and fatty acid content

Formulation:

19 parts tallow fatty acid methyl ester sulfonate - sodium
48 parts adducts of 7 moles ethylene oxide with oleyl/cetyl alcohol
x parts coconut/palm kernel oil fatty acid Viscosity in dependence upon temperature and fatty acid content Formulation:

19 parts tallow fatty acid methyl ester sulfonate - sodium
48 parts adducts of 7 moles ethylene oxide with oleyl/cetyl alcohol
5 parts water
x parts coconut/palm kernel oil fatty acid Viscosity in dependence upon temperature and water content Formulation:

19 parts tallow fatty acid methyl ester sulfonate - sodium
48 parts adducts of 7 moles ethylene oxide with oleyl/cetyl alcohol
5 parts coconut/palm kernel oil fatty acid
x parts water Viscosity in dependence upon temperature and water content Formulation.

19 parts tallow fatty acid methyl ester sulfonate - sodium
48 parts adduct of 7 moles ethylene oxide with oleyl-cetyl alcohol
10 parts coconut/palm kernel oil fatty acid
x parts water Viscosity in dependence upon temperature and water content Formulation:

19 parts tallow fatty acid methyl ester sulfonate - sodium
48 parts adduct of 7 moles ethylene oxide with oleyl/cetyl alcohol
19 parts coconut/palm kernel oil fatty acid
x parts water Washing tests 30°C, 16° h, liquor 1:12, washing time = 15 mins.
10 steel balls, dosage = 10 g washing powder/l
nonionic surfactant:
a. - adduct of 7 moles ethylene oxide with 1 mole coconut oil fatty alcohol
b. - adduct of 7 moles ethylene oxide with 1 mole oleyl/cetyl alcohol
c. - 10% by weight a) + 75% by weight b) + 15% by weight of an adduct of 10 moles ethylene oxide with oleyl/cetyl alcohol

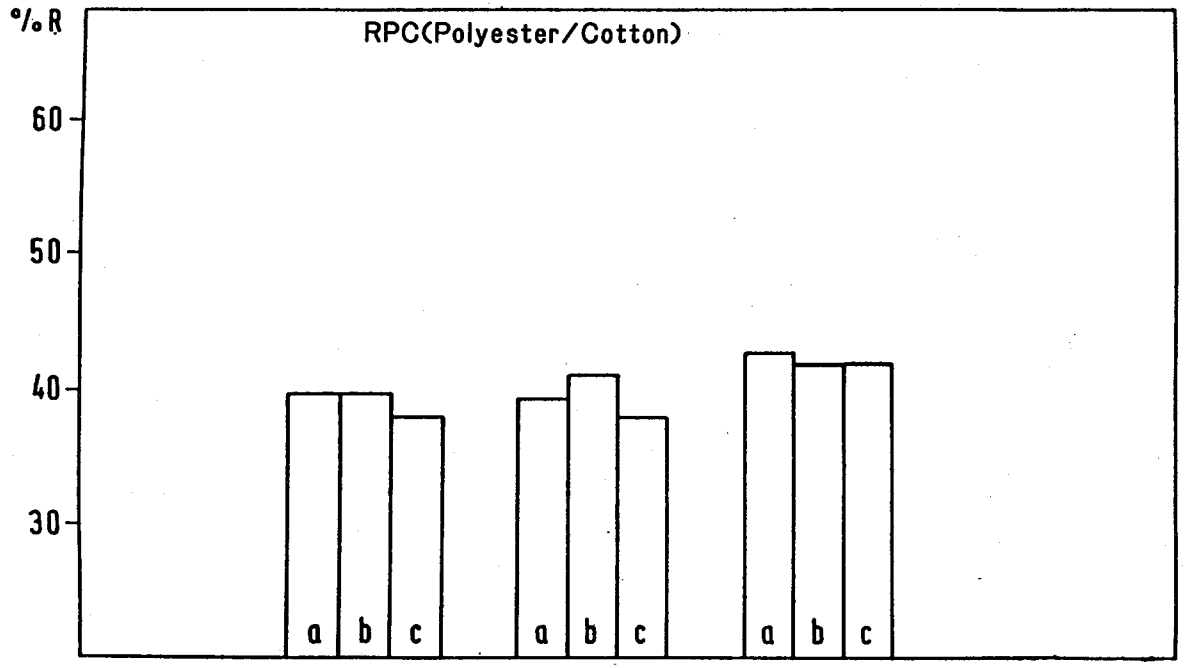

FIG. 8

| | | | | |
|---|---|---|---|---|
| Anionic surfactant: | ES | ES | ABS | ES=Tallow fatty acid methyl ester sulfonate |
| Nonionic surfactant | 3%:5% | 5%:5% | 8%:3% | ABS=Alkylbenzene sulfonate |

Washing tests 90°C, 16° h, liquor 1:12, washing time = 15 mins.
10 steel balls, dosage = 10 g washing powder/l
nonionic surfactant:
a. - adduct of 7 moles ethylene oxide with 1 mole coconut oil fatty alcohol
b. - adduct of 7 moles ethylene oxide with 1 mole oleyl/cetyl alcohol
c. - 10% by weight a) + 75% by weight b) + 15% by weight of an adduct of 10 moles ethylene oxide with oleyl/cetyl alcohol

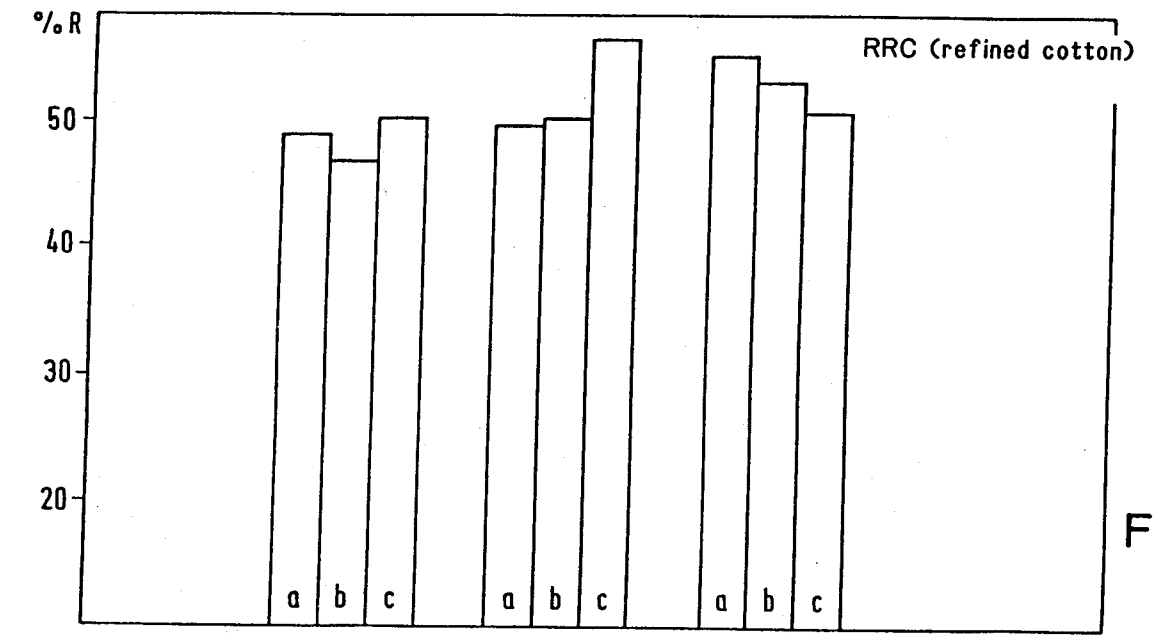

FIG. 9

ES = Tallow fatty acid methyl ester sulfonate
ABS = Alkylbenzene sulfonate

Washing tests 60°C, 16° h, liquor 1:12, washing time = 15 mins.
10 steel balls, dosage = 10 g washing powder/l
nonionic surfactant:
a. - adduct of 7 moles ethylene oxide with 1 mole coconut oil fatty alcohol
b. - adduct of 7 moles ethylene oxide with 1 mole oleyl/cetyl alcohol
c. - 10% by weight a) + 75% by weight b) + 15% by weight of an adduct of 10 moles ethylene oxide with oleyl/cetyl alcohol

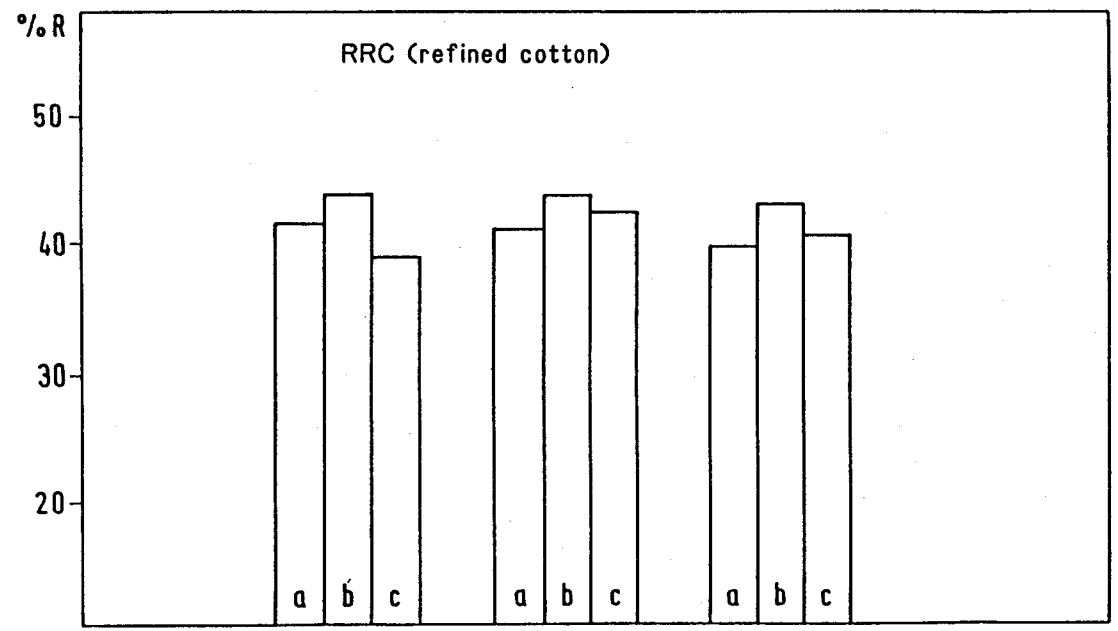

ES = Tallow fatty acid methyl ester sulfonate
ABS = Alkylbenzene sulfonate

FIG. 10

SURFACTANTS CONCENTRATES CONTAINING ESTER SULFONATES AND THEIR USE

BACKGROUND OF THE INVENTION

1. Field of the Invention

This invention related to surfactant concentrates containing ester sulfonates and to their use in domestic and industrial cleaning preparations.

2. Description of Related Art

In industrial processes, α-sulfofatty acid ester salts are obtained in the form of aqueous pastes by neutralization of α-sulfofatty acid esters with aqueous alkail hydroxide. The starting materials used in these processes are fats and/or oils of natural origin which are obtained by ester cleavage and subsequent esterification with lower alkanols, particularly methanol, or by transesterification of natural triglycerides with lower alkanols. The fatty acid ester mixtures formed contain fatty acids in which the length of the alkyl chains covers a comparatively broad range, depending on the origin of the natural starting material. $C_{10}$–$C_{24}$ fatty acids are normally used. Tallow or palm oil are preferred as natural starting materials.

The sulfonation of the fatty acid ester mixtures with gaseous $SO_3$ leads to more or less heavily discolored acidic crude sulfonates which have to be bleached and converted into ester sulfonate pastes by neutralization to a pH-value of from about 6 to 7. Pastes such as these are acquiring increasing practical significance as surface-active agents or wetting agents for detergents and cleaning preparations which may be prepared from natural raw materials.

Pastes of alkail metal salts of α-sulfonated fatty acid alkyl esters (also known as "ester sulfonate salts") are difficult to handle on an industrial scale insofar as they show unusual concentration/viscosity behavior. It is only in comparatively low solids concentrations in water, for example, up to solids contents of around 35% by weight, that solutions or suspensions such as these can be stirred or transported and pumped sufficiently well without interfering with the course of industrial processes. "Pumpable" products are generally understood to be products which have a viscosity below 10,000 mPas at a temperature of around 70° C. Higher solids contents (above about 40% by weight) in solutions or suspension of ester sulfonate salts lead to a disproportionately high increase in viscosity so that the mixtures can no longer be said to be free-flowing and pumpable. This gives rise to several major disadvantages. Highly concentrated ester sulfonate salt pastes cannot be directly neutralized by neutralization of the crude sulfonic acid mixture with aqueous alkail metla hydroxide solution because the fluidity and hence the uniform mixing of the components of the neutralization reaction is no longer guaranteed. In addition, it is not possible on an industrial scale to dissipate the heat of the neutralization reaction to the necessary extent. The resulting increase in both the concentration and the reaction temperature produces undesirable secondary reactions, including in particular an undesirably high formation of disalts of the α-sulfofatty acid with ester cleavage. In addition, it may be regarded as a disadvantage that, in view of the increase in viscosity, the ester sulfonate pastes obtained can no longer be pumped off or transported through pipelines on an industrial scale. The pipelines become blocked so that the operation of the plant as a whole is interrupted for prolonged periods.

Heretofore, numerous proposals have been put forward with a view to improving the situation. Thus, German Application 33 05 430 proposes the addition of long-chain, optionally substituted alcohols as viscosity regulators. This enables the viscosity to be reduced to below the desired level of 10,000 mPas at 70° C.

According to German Application 33 34 517, aqueous suspensions of α-sulfofatty acid ester salts are said to be sufficiently fluid after an addition of lower alcohol sulfates and lower alcohols. The aforementioned viscosity-reducing compounds are initially introduced into the reaction mixtures in higher concentrations than ultimately necessary, and then removed by concentration.

According to German Application 31 23 681, a highly concentrated aqueous solution of an α-sulfofatty acid ester salt is prepared by initially neutralizing the crude sulfonic acid to a pH-value of from 2.5 to 4 with caustic alkali metal solution in the presence of a lower alcohol and then bringing the pH-value to the necessary level of 6 to 7 by addition of more alkali metal solution in a second neutralization step.

The known proposals mentioned above all relate to the usual industrial starting materials, i.e., fatty acids of natural origin in which the alkyl groups in the natural fatty acid mixture cover a comparatively broad chain-length range, e.g., from $C_{10}$ to $C_{24}$. With a narrower chain-length range of the alkyl group in the natural fatty acids, for example from $C_{16}$ to $C_{18}$, as obtained for example in the splitting of tailow or in the working up of palm oil, the measures to lower viscosity may be distinctly reduced. This is the subject of German patent application P 34 39 520.0, according to which aqueous pastes of ester sulfonate salts prepared from $C_{16}$–$C_{18}$ fatty acids have solids contents of at least 60% by weight and are pumpable at 60° C. although they are substantially free from viscosity regulators. However, ester sulfonate salt pastes of this type are attended by the disadvantage that, as stated in German patent application 34 39 520.2, they have comparatively high contents of "disalt", i.e. disalts of a α-sulfofatty acid, which are formed with cleavage of the ester in the strongly alkaline medium. Disalts such as these, which may make up as much as 25% by weight of technical degree α-sulfofatty ester salts are highly undesirable as a secondary product because they seriously impair the flow properties of the pastes. Accordingly, a "disalt" content below 25% by weight is desirable for high-quality ester sulfonate pastes.

An object of the present invention is to provide alkali metal salts of α-sulfonated fatty acid alkyl esters in a form in which they are fluid and pumpable at low temperature, i.e., alkali metal salts thereof having a viscosity below about 10,000 mPas. The ester sulfonate salts herein are to be made available with high active-substance contents, i.e. contents of surfactants of distinctly greater than 50% are to be obtained in the concentrates.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that concentrates of alkali metal salts of α-sulfonated fatty acid alkyl esters which are fluid and pumpable at low temperatures can be obtained by adding nonionic surfactants, fatty acids and, optionally, small quantities of water to α-sulfofatty acid alkyl ester salts in such amounts that the content of washing active substance (ester-sulfonate+disalt+nonionic surfactant+fatty acid) amounts to 90 to 100% by weight. Accordingly, the invention relates to ester-sulfonate-containing surfactant concentrates which contain (a) one or more surfactants in a quantity of 50 to 70% by weight, based on the total weight of the concentrates, said surfactants being selected from the group consisting of (α) alkali metal salts of α-sulfonated fatty acid alkyl esters of $C_{16}$ and/or $C_{18}$ fatty acids and alcohols containing from 1 to 8 carbon atoms in the alkyl group, and (β) linear aliphatic fatty alcohol polyglycol ethers containing from 10 to 20 carbon atoms in the alkyl group of the alcohol and from 3 to 15 ethoxy groups in the molecule, the ratio of the surfactant component (α):(β) being from 1:0.3 to 1:3; (b) one or more saturated and/or unsaturated, linear aliphatic $C_8$–$C_{22}$ carboxylic acid in a quantity of from 10 to 30% by weight, based on the total weight of the concentrates; and (c) water in a quantity of from 0 to 10% by weight, based on the total weight of the concentrates. Additionally, the surfactant concentrates may contain besides disalts other by-products from the preparation of the main products which by-products may amount up to 25% by weight, based on the total weight of the concentrates.

In addition, the invention relates to the use of these concentrates in fabric detergents, dishwashing detergents and cleaning preparations for domestic and industrial purposes in a quantity of from 1 to 15% by weight of washing-active substance, based on the total weight of the fabric/dishwashing detergent or cleaning preparation.

The ester-sulfonate-containing surfactant concentrates according to the invention contain (a) one or more surfactants as their principal constituent. The surfactant component of the concentrates is made up of two groups of surfactants, namely, anionic surfactants (α) and nonionic surfactants (β). According to the invention, the alkali metal salts of α-sulfonated fatty acid alkyl esters known per se from the prior art are used as the anionic surfactants. Suitable alkali metal salts of this type include lithium salts, sodium salts, potassium salts or rubidium salts. By virtue of the ready availability of the raw materials such as sodium hydroxide or soda, potassium hydroxide or potash, the sodium salts and potassium salts of the α-sulfonated fatty acid alkyl esters are preferred.

The fatty acid alkyl esters are selected from the group of esters of $C_{16}$ and/or $C_{18}$ fatty acids. Fatty acids such as these accumulate in large quantities in processes for working up natural fats and/or oils. Thus, the production of oleic acid by splitting of tallow by the so-called hydrophilization process or the working up of palm oil leads to a product which contains $C_{16}$ and $C_{18}$ fatty acids in a ratio of approximately 1:1. Natural fats and/or oils such as these are thus particularly suitable as a starting material for the surfactants in the surfactant concentrates according to the invention. However, other fatty acid sources may also be used. Thus, the production of palm stearin from palm oil leads to fatty acid mixtures having a $C_{16}$ to $C_{18}$ ratio of approximately 60:40. Many of the fatty acid cuts obtained in the working up of tallow on an industrial scale also have carbon chain lengths in the above-mentioned range. In addition, hardened soya oil also predominantly contains $C_{16}$ and $C_{18}$ fatty acids. In addition to the natural sources mentioned, however, other sources are also possible, particularly those from which fatty acids having the aforementioned chain length may be obtained after chemical conversion, for example hardening by preceding hydrogenation steps.

The alkali metal salts of α-sulfonated fatty acid alkyl esters present as anionic surfactants contain as their ester constituent alcohols containing from 1 to 8 carbon atoms in the alkyl group. Alcohols such as these include methanol, ethanol, propanol, isopropanol, butanol, sec.-butanol, isobutanol, tert.-butanol and also pentanol, hexanol, heptanol and octanol and their isomers. Alcohols containing from 1 to 4 carbon atoms in the alkyl group are preferred, methanol and ethanol being used with particular advantage. The fatty acid alkyl esters are formed by transesterification from the above-mentioned fats or oils available from natural sources or by direct esterification of the fatty acids prepared in pure form beforehand.

The introduction of the sulfo group in the α-position is carried out in known manner primarily by reaction of the corresponding fatty acid esters or fatty acid ester mixtures with gaseous $SO_3$. The compounds obtained are further processed, i.e. for example, bleached and neutralized, by methods known per se.

In addition to the anionic surfactants mentioned, the surfactant concentrates containing ester sulfonates according to the invention also contain nonionic surfactants selected from the group comprising linear, aliphatic fatty alcohol polyglycol ethers. Such fatty alcohol polyglycol ethers are formed in known manner by reaction of long-chain fatty alcohols with ethylene oxide in the particular molar ratio required for the product. The fatty alcohols employed generally have an alkyl chain length of from 10 to 20 carbon atoms, and preferably of from 10 to 16 carbon atoms. Accordingly, suitable fatty alcohols of the type herein include undecanol, dodecanol, tridecanol, tetradecanol, pentadecanol, hexadecanol, heptadecanol, octadecanol, nonadecanol and elcosanol.

The linear aliphatic fatty alcohols may be ethoxylated with ethylene oxide in a molar ratio of from 1:3 to 1:15, so that the average content of the ethoxy groups in the molecule of the fatty alcohol polyglycolether is from 3 to 15 ethoxy groups per molecule. An ethoxy group content therein of from 3 to 10 per molecule is preferred.

The surfactants from the afore-mentioned two groups of anionic and nonionic surfactants may be used either individually or in admixture with one another as a component of the ester-sulfonate-containing surfactant concentrates according to the invention. According to the invention, the ratio of anionic to nonionic surfactant, i.e. component (α) to component (β), is in the range of from 1:0.3 to 1:3, and preferably in the range of from 1:1 to 1:2.

Overall, the concentrates have a surfactant content of 50 to 70% by weight, based on the total weight of the concentrates. Preferred concentrates are those containing one or more of the above-mentioned surfactants in a quantity of 50 to 60% by weight, based on the total weight of the concentrates.

The concentrates according to the invention contain as an additional component one or more saturated and/or unsaturated linear aliphatic carboxylic acid which is understood above all to be a saturated or unsaturated fatty acid containing from 8 to 22 carbon atoms. Fatty acids such as these, similarly as the fatty acids mentioned above, may be obtained from natural sources or may be derived therefrom by chemical reaction. The fatty acids herein include in particular caprylic acid, pelargonic acid, capric acid, undecanoic acid, lauric acid, tridecanoic acid, myristic acid, petadecanoic acid, palmitic acid, margaric acid, stearic acid, nonadecanoic acid, arachic acid and behenic acid as saturated fatty acids; palmitoleic acid, oleic acid and erucic acid and also linoleic acid and linolenic acid as unsaturated fatty acids. Preferred fatty acid components are oleic acid obtainable by the splitting of tallow and also palmitic acid, stearic acid and linoleic acid, i.e. fatty acids containing 16 and/or 18 carbon atoms.

The quantity of fatty acid in the concentrates according to the invention is in the range of from 10 to 30% by weight, based on the total weight of the concentrates, and preferably in the range of from 15 to 20% by weight. In general, the chain length of the fatty acid added does not significantly affect the change in viscosity of the concentrates according to the invention, i.e. all fatty acids have basically the same effect.

The surfactant concentrates containing ester sulfonates according to the invention may also contain water as an optional constituent. Where a water content is included, it is in the range of from 1 to 10% by weight, based on the weight of the concentrates. This means that the concentrates according to the invention are products which, depending on their water content, contain from 90 to 100% by weight of washing-active substance.

The concentrates according to the invention containing the above-mentioned components may be used with advantage in fabric detergents, dishwashing detergents and cleaning preparations for domestic and industrial purposes. To this end, the concentrates are added to standard cleaning liquors in quantities of from 1 to 15% by weight of washing-active substance, based on the total weight of the fabric/dishwashing detergent or cleaning preparation. The quantity used is governed by various parameters, such as water hardness, filed of application, etc.

It has surprisingly been found that the surfactant concentrates and the detergents and cleaning preparations prepared with them produce equally good or even better washing results for a lower content of washing-active substance compared with the prior art. Thus, it has been found that detergent formulations based on alkylbenzene sulfonates containing 11% by weight washing-active substance produce at most equally good, but generally much poorer washing results than detergents based on the ester-sulfonate-containing concentrates acording to the present invention for low contents of washing-active substance.

BRIEF DESCRIPTION OF THE DRAWINGS

FIGS. 6 to 8 are graphs showing the results of washing tests on soiled polyester/cotton fabric at varying temperatures in terms of percent remission using detergents prepared from concentrate compositions of this invention.

FIGS. 9 to 11 are graphs showing the results of washing tests on soiled refined cotton fabric at varying temperatures in terms of percent remission using detergents prepared from concentrate compositions of this invention.

Figure 1:
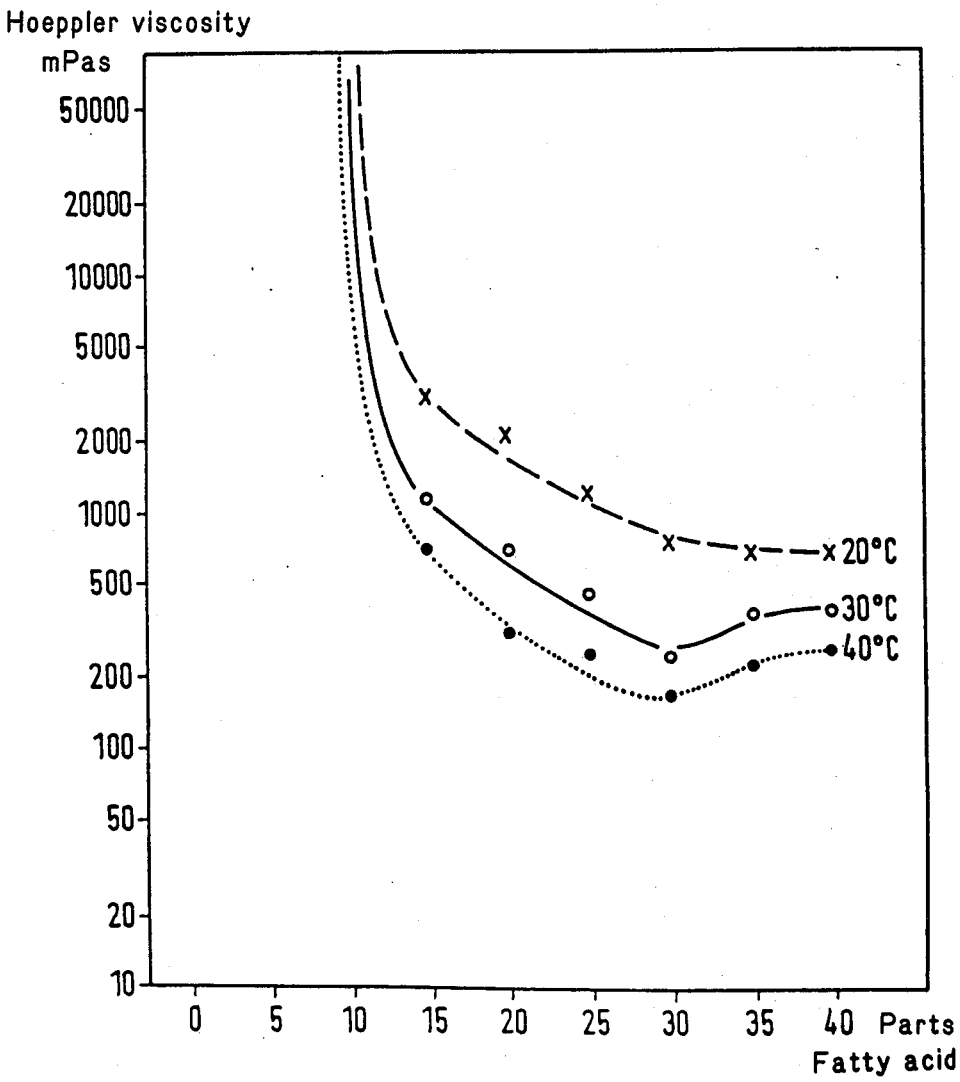
FIG. 1 is a graph showing the dependence of viscosity upon temperature and fatty acid content of an ester-sulfonate-containing concentrate composition.

The invention is further illustrated by the following examples wherein the anionic surfactant used (component ($\alpha$)) was Texin ® ES 68, a technical degree tallow fatty acid methyl ester sulfonate sodium salt in powder form. This technical product contained 69% by weight of ester-sulfonate and 16% by weight of disalt.

The viscosity of the surfactant concentrates was measured in a Hoeppler viscosimeter.

EXAMPLE I

Preparation of an ester-sulfonate-containing concentrate

An ester-sulfonate-containing surfactant concentrate according to the invention was prepared using the above described anionic surfactant Texin ® ES 68 in powder form.

48 g of an adduct of 7 moles of ethylene oxide with an oleyl/cetyl alcohol mixture were initially introduced in admixture with coconut/palm kernel oil fatty acid in various concentrations (see FIG. 1). 28 g of Texin ® ES 68 were introduced into the resulting mixture and completely dissolved therein at elevated temperature. The resulting solution was stirred for 0.5 hour. The viscosity of this solution was 1800 mPas (20° C.).

EXAMPLE II

Preparation of another ester-sulfonate-containing surfactant concentrate directly from the acidic ester sulfonate 44.5 g of an adduct of 7 moles of ethylene oxide with oleyl-cetyl alcohol and 27.0 g of coconut/palm kernel oil fatty acid were initially introduced, after which 23.5 g of acidic ester sulfonate were introduced into and dissolved in the mixture. 5.0 g of a 50% sodium hydroxide solution were then added dropwise with vigorous stirring. The alkali metal salt of the ester sulfonate was formed in the mixture with slight evolution of heat. The viscosity of the mixture was 1650 mPas (20° C.).

EXAMPLE III

Dependence of viscosity on temperature and fatty acid content 28 parts by weight of Texin ® Es 68 in powder form were mixed with 48 parts by weight of an adduct of 7 moles of ethylene oxide with oleyl/cetyl alcohol. 5 to 40 parts by weight (see FIG. 1) of coconut/palm kernel oil fatty acid were added to the resulting mixture in portions.

As can be seen from FIG. 1, the viscosity value fell dramatically above a fatty acid content of approximately 10 parts. Fatty acid concentrations above 20 parts produce no further reduction in viscosity.

The viscosity behavior as a function of the fatty acid content was unaffected by temperature, even in the range of from 20° to 40° C. As can be seen from FIG. 1, comparable reductions in viscosity were measured above a fatty acid content of approximately 10 parts by weight.

Figure 2:
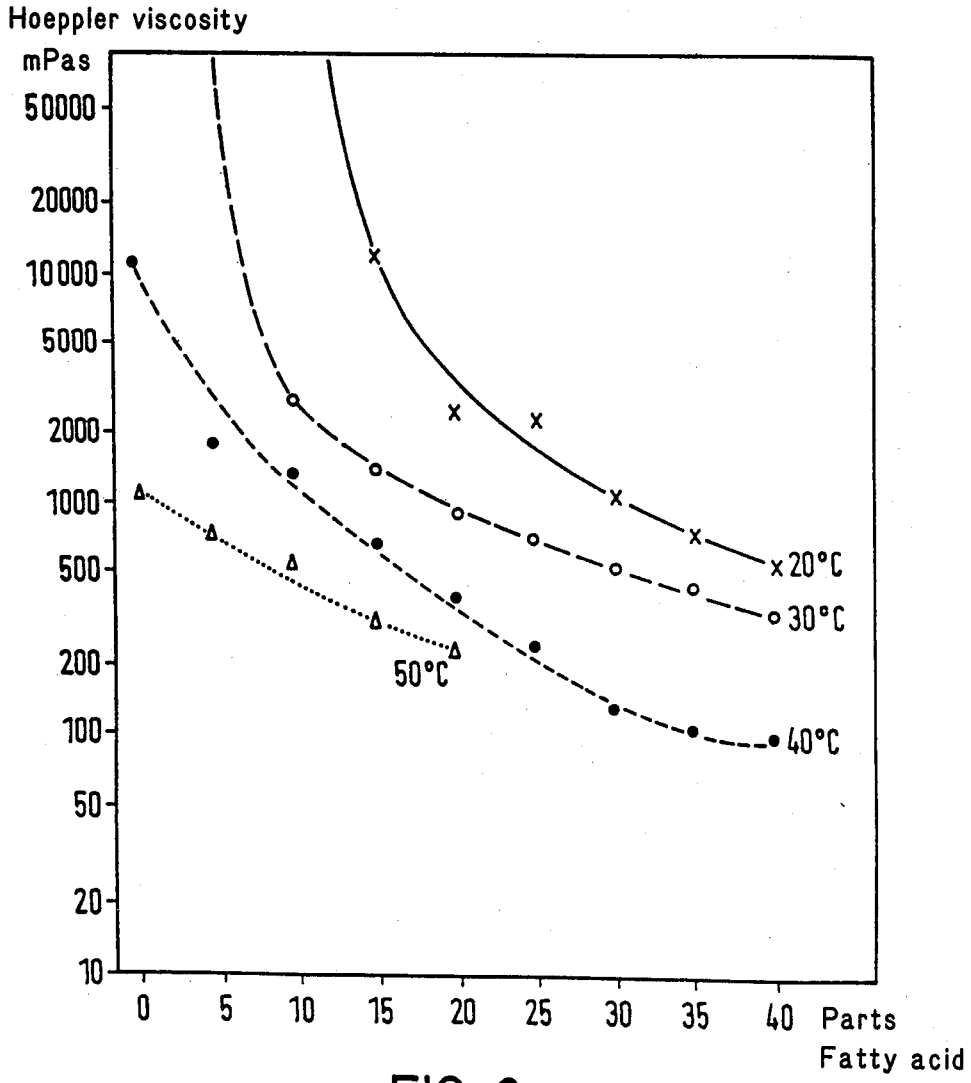
FIG. 2 is a graph showing the dependence of viscosity upon temperature, fatty acid content, and water content of an ester-sulfonate-containing concentrate composition.

An addition of water to the system illustrated in FIG. 1 produced a reduction in viscosity even at a distinctly lower fatty acid concentration. As shown in FIG. 2, a viscosity considerably below 10.000 mPas could be achieved in some cases even at low fatty acid concentrations, i.e., at 5 to 15 parts by weight

EXAMPLE IV

Dependence of viscosity on the type of fatty acid used in the concentrate

Various types of fatty acids were tested for their effect in the concentrates according to the invention. Fatty acids of different chain length and iodine number were used in a concentration of 19 parts by weight, based on the concentrate as a whole. The following fatty acids were used:

coconut/palm kernel oil fatty acid, I. No. = 16–22;
coconut oil fatty acid, I. No. = 8–14;
Hydrogenated coconut/palm kernel oil fatty acid, I, No. = <1;
caprylic/capric acid, I. No. = 0.1–1;
soya oil fatty acid, I. No. = 120–130;
oleic, I. No. = 86–92; and
lauric acid, I. No. = <0.1.

Further constituents of the concentrates tested included:

28 parts by weight of Texin ® ES 68 in powder form;
48 parts by weight adduct of 7 moles of ethylene oxide with oleyl/cetyl alcohol; and
5 parts by weight of water.

It was found that neither the iodine number nor the chain length of the fatty acids have a significant effect upon the viscosity of the concentrates according to the invention.

EXAMPLE V

Figure 3:
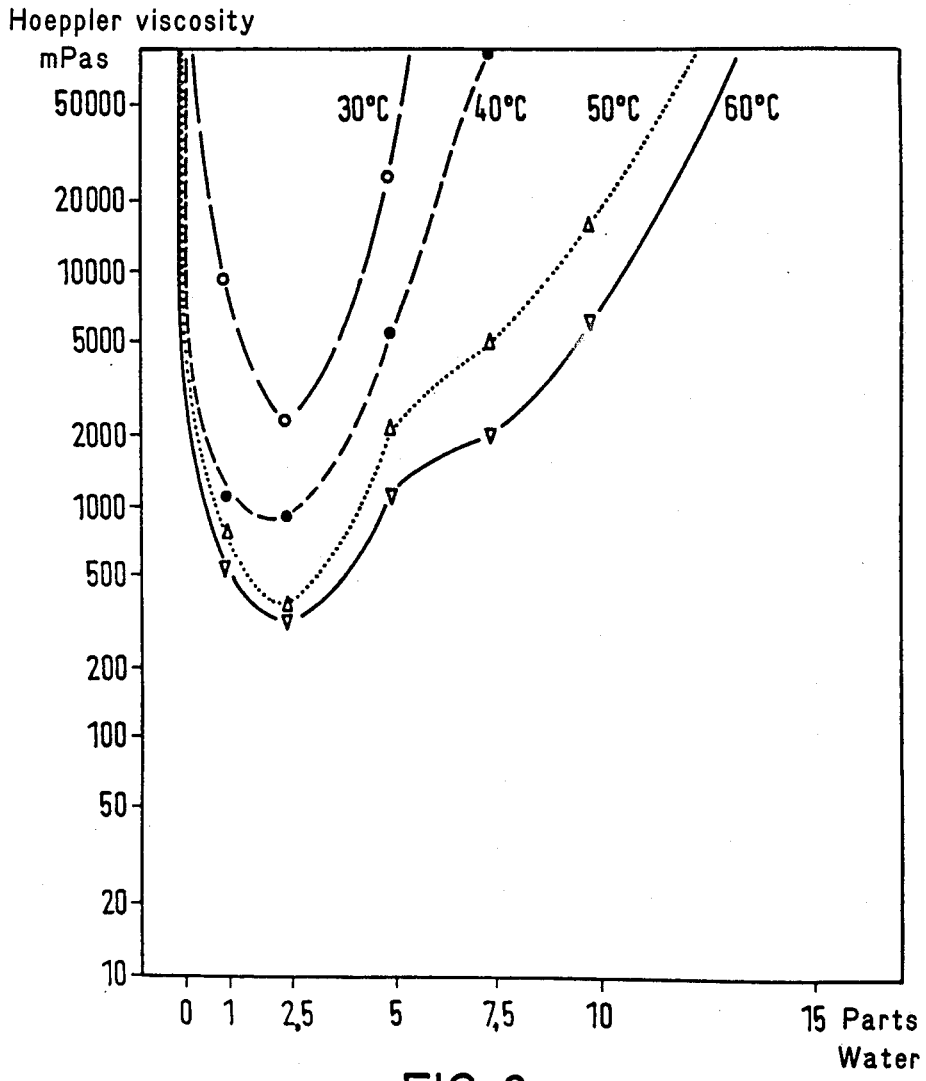
FIGS. 3 to 5 are graphs showing the dependence of viscosity upon temperature, fatty acid content, and water content of an ester-sulfonate-containing concentrate composition.
Figure 4:
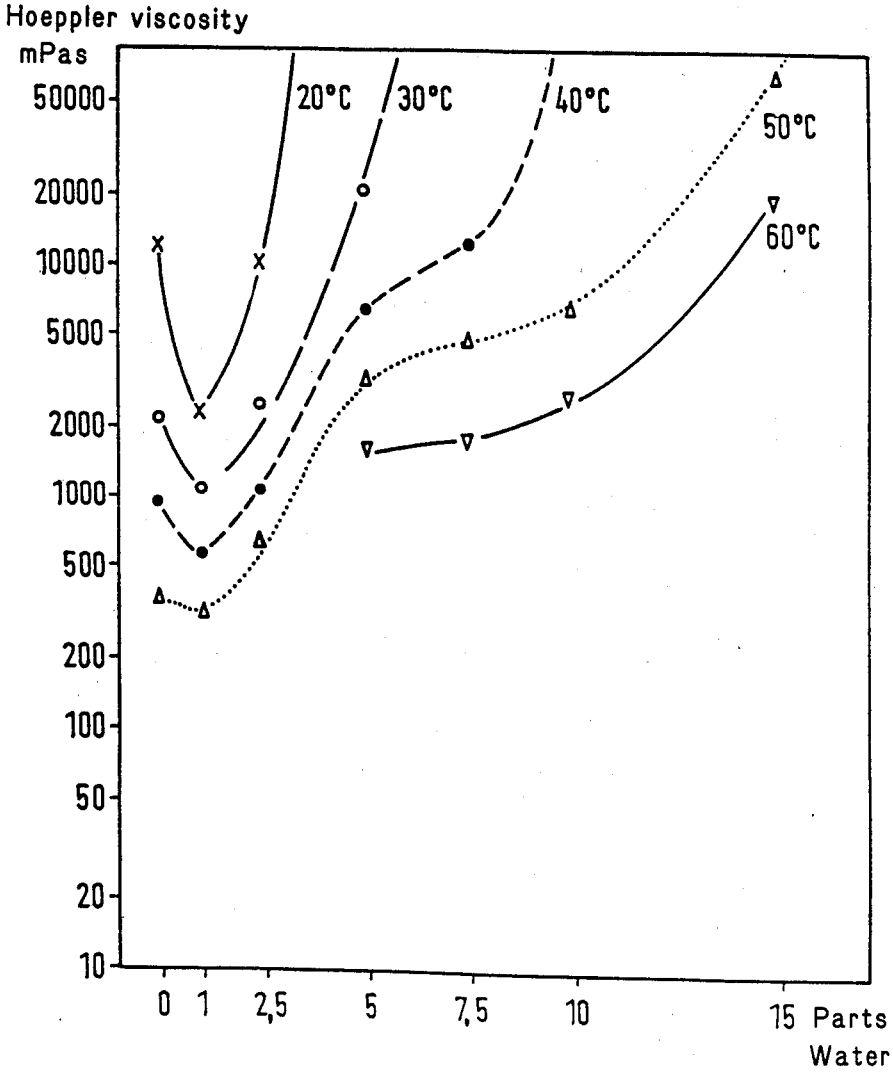
Figure 5:
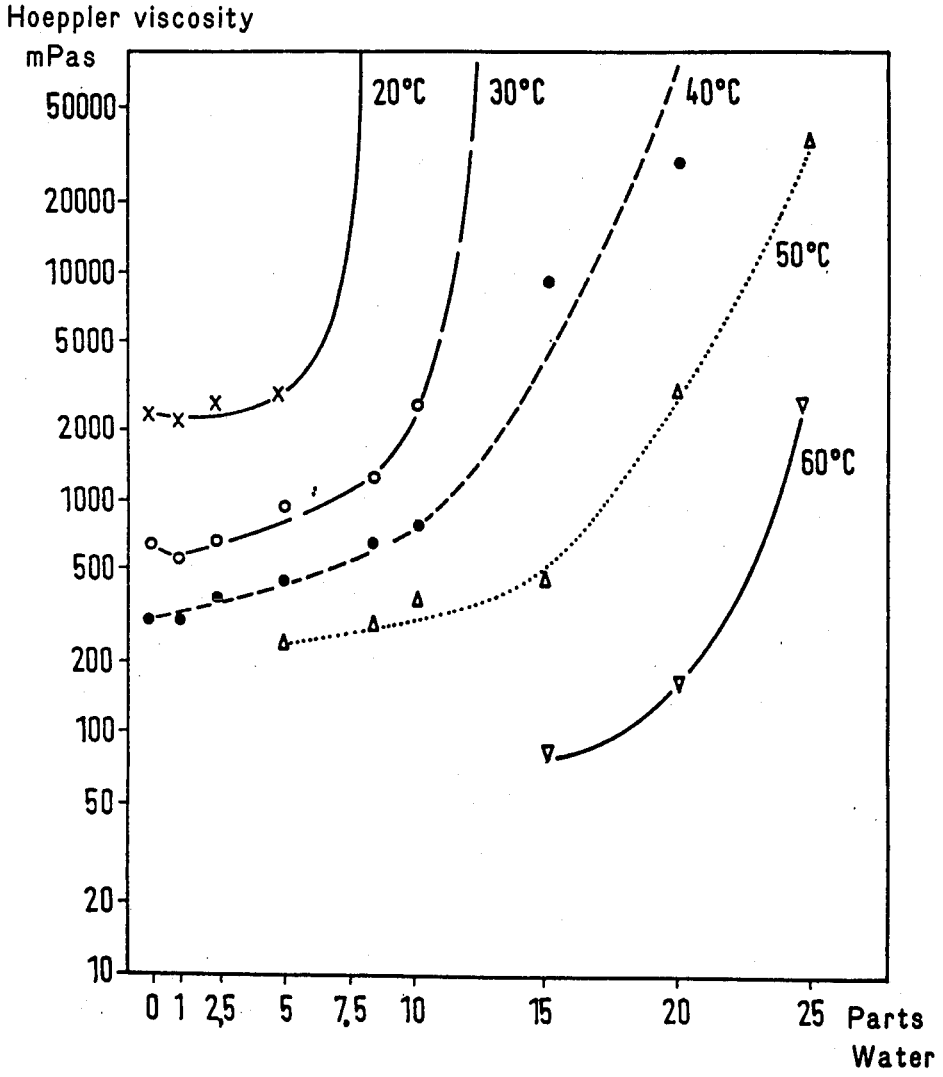
Figure 6:
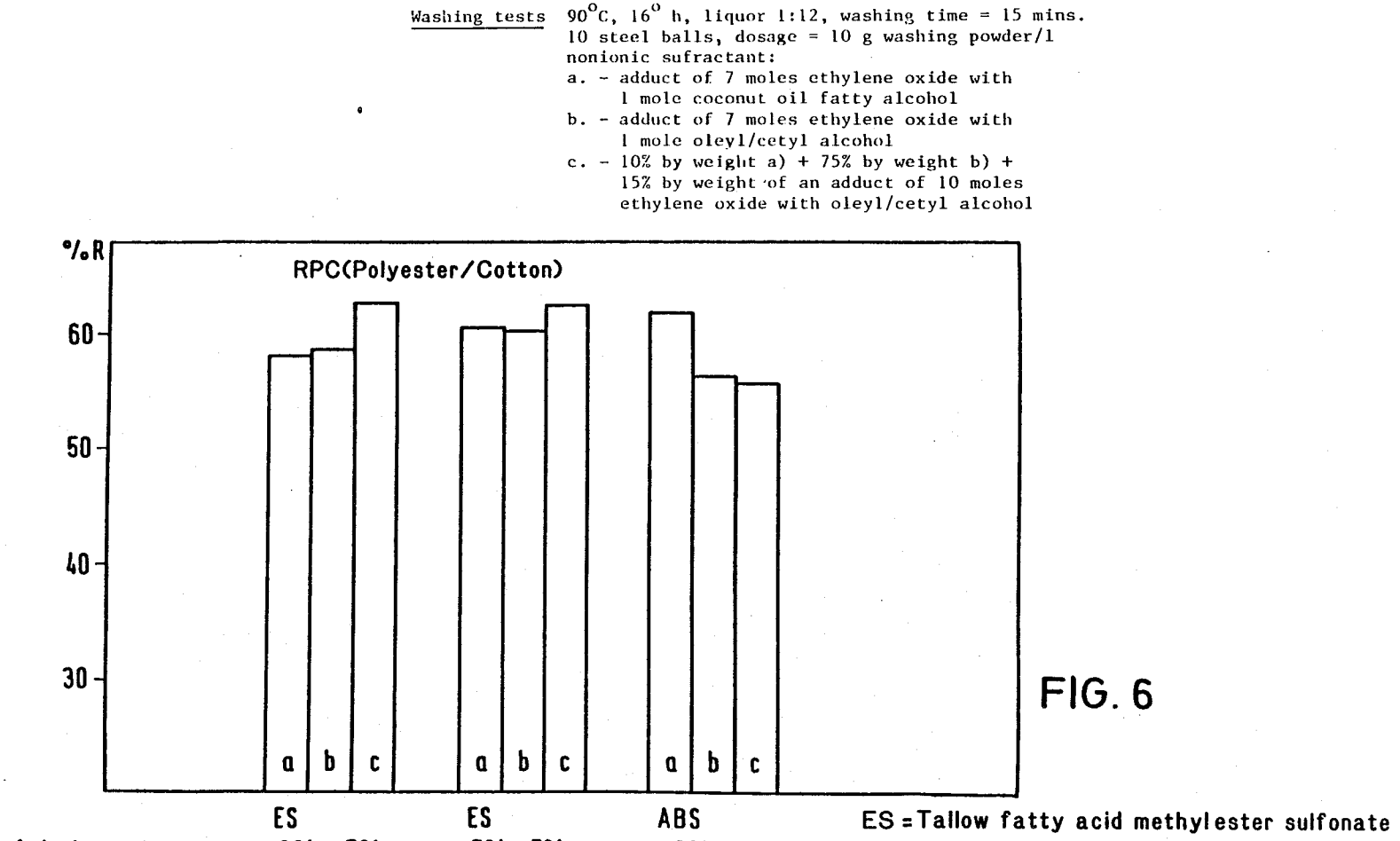
Figure 7:
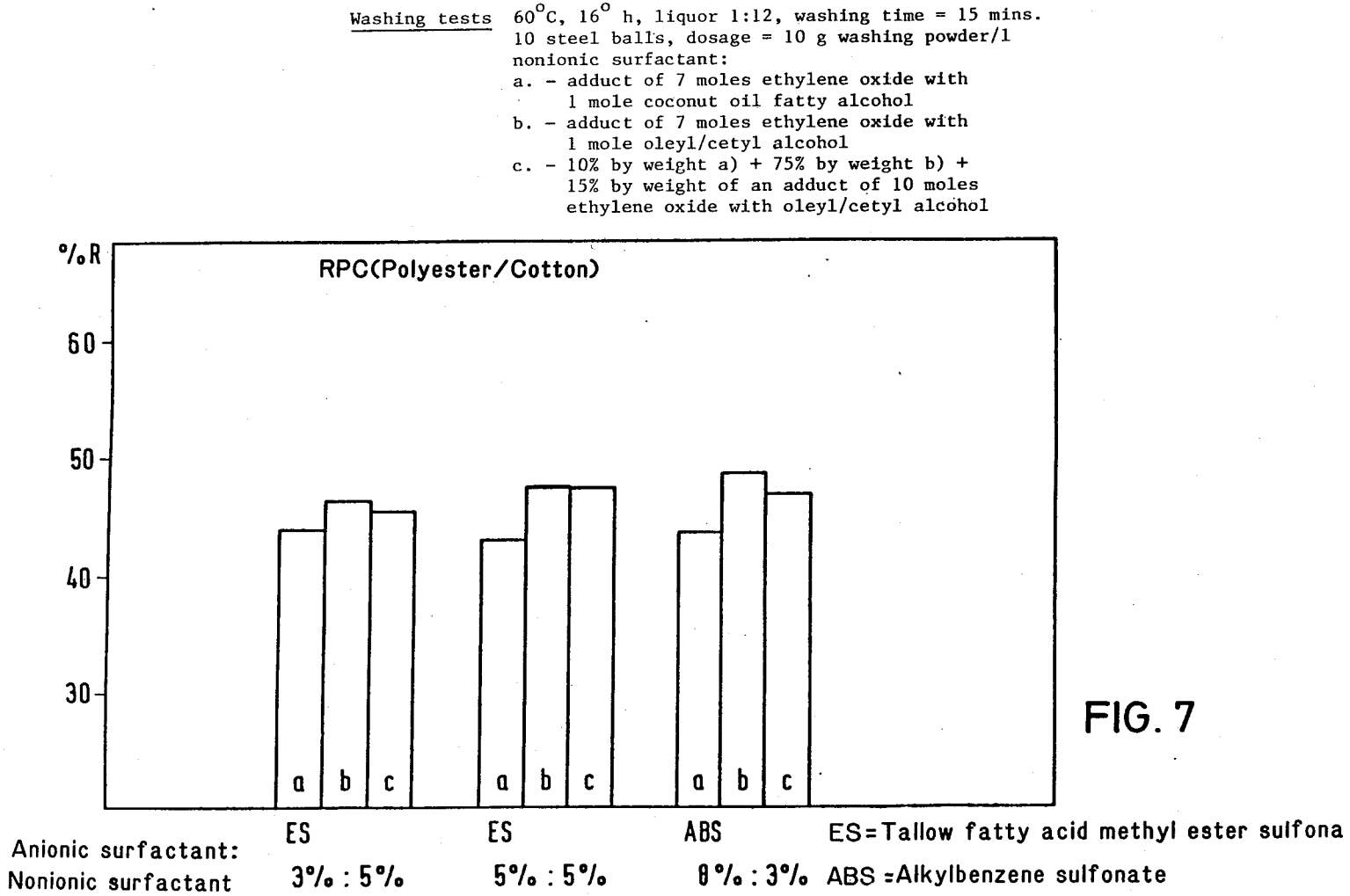
Figure 11:
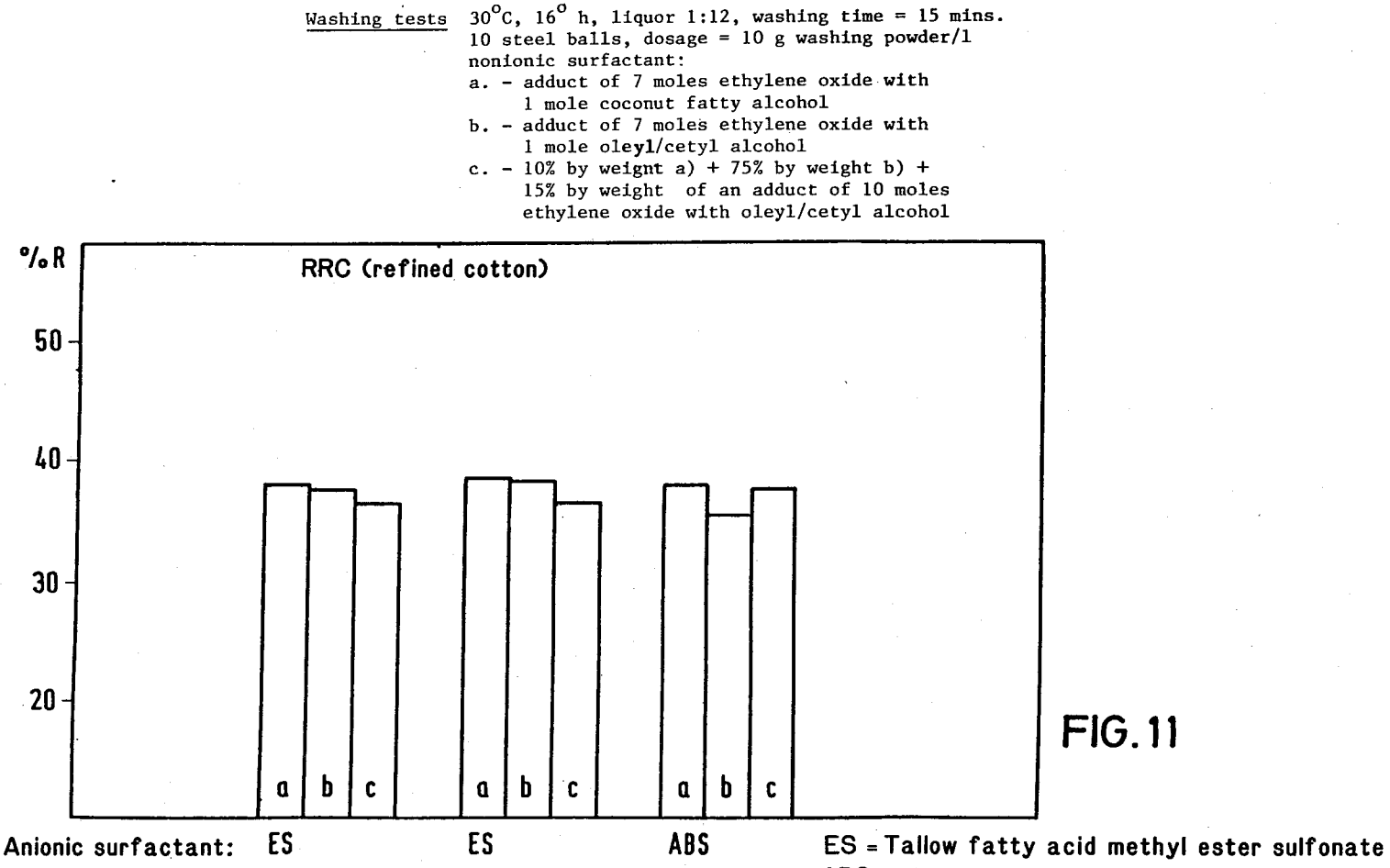

Dependence of viscosity on water content 48 parts by weight of an adduct of 7 moles of ethylene oxide with oleyl/cetyl alcohol, and 5 parts by weight, 10 parts by weight and 19 parts by weight, respectively, of coconut/palm kernel oil fatty acid were added to 28 parts by weight of Texin ® ES 68 in powder form. Various quantities of water were introduced into these mixtures. The result is shown in FIGS. 3 to 5. In every case, it was found that the viscosity of the water-containing mixtures passed through a minimum which was at about 2.5 to 5 parts by weight of water for low fatty acid contents (see FIG. 3) and which shifts towards lower water contents with increasing quantities of fatty acid (see FIGS. 4 and 5). Accordingly, there is no need to add water to the ester sulfonate concentrates according to the invention where they have relatively high fatty acid contents.

EXAMPLE VI

Washing tests

Detergents were prepared using the ester-sulfonate-containing surfactant concentrates according to the invention and were used to carry out washing tests in a so-called Launderometer. 8.2 g of fabrics (two swatches of test fabric and two swatches of cotton filler fabric) were washed for 15 minutes with 10 steel balls in the Launderometer (washing temperatures 30°, 60°, and 90° C.; water hardness 16° German hardness) and then rinsed twice for 2 minutes in cold tapwater. The liquor ratio was 1:12. The whiteness of the dried and ironed swatches was measured (Zelss ELREPHO) and expressed in % remission (R).

The test fabrics used were swatches of polyester/cotton (RPC) and refined cotton (RRC) each soiled with pigment/sebum.

The respective detergents were used in a dosage of 10 g per liter of liquor. The composition of the detergents is shown in the following tabular summary:

3 to 8% by weight anionic surfactant (alkylbenzene sulfonate = ABS; ester sulfonate = ES);
3 to 5% by weight nonionic surfactant;
(a) = coconut oil fatty alcohol + 7 moles ethylene oxide
(b) = oleyl/cetyl alcohol + 7 moles ethylene oxide
(c) = mixture of 10% by weight a) + 75% by weight b) + 15% by weight oleyl/cetyl alcohol + 10 moles ethylene oxide
2% by weight soap, expressed as tallow fatty acid;
26% by weight sodium tripolyphosphate;
1% by weight carboxymethyl cellulose;
5% by weight soda waterglass 1:3.35; and sodium sulfate ad 100% by weight.

The type and quantity of anionic surfactant and nonionic surfactant used are shown on FIGS. 6 to 11.

It was found that detergents prepared from the ester sulfonate concentrates according to the invention are comparable with state-of-the-art detergents in regard to the washing results obtained. Where the concentrates according to the invention are used in the detergents, the contents of washing-active substance may be lower without any loss of detergency, amounting for example to 8% washing-active substance (3% ester sulfonate and 5% nonionic surfactant) and 10% washing-active substance (5% ester sulfonate and 5% nonionic surfactant).

EXAMPLE VII

A mixture of 33 parts by weight Texin ® ES 68 in powder form (corresponding to 23 parts by weight of ester sulfonate), 36 parts by weight $C_{12}$/18 -fatty alcohol + 10 mol ethylene oxide, 27 parts by weight $C_8$/18 -fatty acid and 4 parts by weight of water resulted into a concentrate having a viscosity of 8500 mPas.

We claim:

1. An ester-sulfonate-containing liquid surfactant concentrate comprising:

(a) one or more surfactants in a quantity of 50 to about 70% by weight, based on the total weight of the concentrate, selected from the group consisting of
($\alpha$) alkali metal salts of $\alpha$-sulfonated fatty acid alkyl esters of $C_{16}$ and/or $C_{18}$ fatty acids and alcohols containing from 1 to 8 carbon atoms in the alkyl group, and
($\beta$) linear aliphatic fatty alcohol polyglycol ethers containing from 10 to 20 carbon atoms in the alkyl group of the alcohol and from 3 to 15 ethoxy groups in the molecule, the ratio between said surfactant components ($\alpha$) and ($\beta$) being from 1:0.3 to 1:3;

(b) one or more saturated and/or unsaturated linear aliphatic $C_8$–$C_{22}$ carboxylic acid in a quantity of from about 10 to about 30% by weight, based on the total weight of said concentrate; and (c) water in a quantity of from 0 to about 10% by weight, based on the total weight of said concentrate.

2. An ester-sulfonate-containing surfactant concentrate in accordance with claim 1 wherein said alkali metal salts of said component ($\alpha$) are selected from sodium salts, potassium salts, lithium salts, and rubidium salts.

3. An ester-sulfonate-containing surfactant concentrate in accordance with claim 1 wherein said component ($\alpha$) comprises the sodium and/or potassium salt of $\alpha$-sulfonated fatty acid methyl esters of $C_{16}$ and/or $C_{18}$ fatty acids.

4. An ester-sulfonate-containing surfactant concentrate in accordance with claim 1 wherein said component ($\beta$) fatty alcohol polyglycol ethers contain from about 10 to about 16 carbon atoms in the alkyl group of the alcohol.

5. An ester-sulfonate-containing surfactant concentrate in accordance with claim 1 wherein said component ($\beta$) fatty alcohol polyglycol ethers contain from about 3 to about 10 ethoxy groups per molecule.

6. An ester-sulfonate-containing surfactant concentrate in accordance with claim 1 wherein the ratio between said surfactant components ($\alpha$) and ($\beta$) is from about 1:1 to about 1:2.

7. An ester-sulfonate-containing surfactant concentrate in accordance with claim 1 wherein said surfactants are present in a quantity of 50 to about 60% by weight, based on the total weight of said concentrate.

8. An ester-sulfonate-containing surfactant concentrate in accordance with claim 1 wherein said component (b) is present in a quantity of from about 15 to about 20% by weight, based on the total weight of said concentrate.

9. An ester-sulfonate-containing surfactant concentrate in accordance with claim 1 wherein said water is present in a quantity of from about 1 to about 10% by weight, based on the total weight of said concentrate.

10. An ester-sulfonate-containing surfactant concentrate in accordance with claim 1 wherein said concentrate contains from about 90 to about 100% by weight of washing-active substance.

11. The process of preparing a fabric detergent dishwashing detergent, or cleaning preparation comprising adding the to the liquid surfactant concentration of claim 1.

* * * * *

UNITED STATES PATENT AND TRADEMARK OFFICE

CERTIFICATE OF CORRECTION

PATENT NO. : 4,772,426

DATED : September 20, 1988

INVENTOR(S) : Koch, et al

It is certified that error appears in the above-identified patent and that said Letters Patent is hereby corrected as shown below:

In the title of the invention on the cover page and at col. 1, line 2, "SURFACTANTS" should read --SURFACTANT--.

On the cover page, under "inventors", the name "Brigitte Glesen" should read --Brigitt Giesen--.

In the "Abstract" at line 5, "alkali metal" should read --alkali metal salts--.

Signed and Sealed this

Fifth Day of September, 1989

*Attest:*

*Attesting Officer*

DONALD J. QUIGG

*Commissioner of Patents and Trademarks*